US005289960A

United States Patent [19]

Kelly et al.

[11] Patent Number: 5,289,960

[45] Date of Patent: Mar. 1, 1994

[54] BALL BELT

[76] Inventors: Nancy A. Kelly, 24435 Copper Cliff Ct., Lake Forest, Calif. 92630; Chulech J. Khau, 18442 Birch St., Fountain Valley, Calif. 92708

[21] Appl. No.: 942,026

[22] Filed: Sep. 4, 1992

[51] Int. Cl.[5] ..... B65D 30/00

[52] U.S. Cl. ..... 224/226; 224/919; 224/235; 383/43

[58] Field of Search ..... 224/224, 226, 227, 228, 224/236, 919, 235; 383/43, 66, 107; 206/315.9

[56] References Cited

U.S. PATENT DOCUMENTS 4,079,871 3/1978 Sica ..... 224/226
4,416,404 11/1983 Daniels ..... 224/224
4,433,803 2/1984 Liberboim ..... 224/919 X
4,461,030 7/1984 Knudsen ..... 383/43 X
4,836,427 6/1989 McManus ..... 224/224

*Primary Examiner*—Henry J. Recla
*Assistant Examiner*—Glenn T. Barrett

[57] ABSTRACT

Two semi-oval pieces of fabric form an elastic pouch attached to a nylon belt. Both end's of the nylon belt are attached to a male and female buckle that secure the belt around the participant's waist. To accommodate different waist sizes, the length can be increased and decreased through a three strand adjustor. The fabric's stretchability allows it to expand and decrease in order to hold one to three tennis balls without falling out of the pouch. When the Ball Belt is not in use, it's flexible construction can be rolled-up, folded or used as a case to carry the tennis balls in.

5 Claims, 3 Drawing Sheets

BALL BELT

BACKGROUND OF THE INVENTION

1. Field of the Invention

This invention relates generally to a nylon belt with an attached elastic pouch that straps around the waist and is designed in particular to hold three tennis balls while the player is engaging in the sporting activity.

2. Description of Prior Art

In the past, many have attempted to design a device to carry tennis balls in that eliminates time and energy in gathering balls. However, those devices have more drawbacks and fall short of the need to provide a suitably comfortable and easily accessible, safe product to wear and to carry balls. Companies, such as, Unique Sports Inc. have designed and trademarked a plastic clip-on ball pocket to hold only one ball. Its design does not allow the ball to be easily removed from its plastic pocket. U.S. Pat. No. 4,416,404 to Daniels (1983) disclosed a device that holds only 2 balls. In addition, the belt's fastener is cumbersome and the tubular construction of the ball chamber does not provide quick and easy access. Further, U.S. Pat. No. 4,433,803 to Liberboim (1984) disclosed a device to hold at least six tennis balls that is suitable only for practice, but not for the comfort of engaging in a game.

Technically, a tennis game without errors would require only one to two balls. Most games have a need for three balls. U.S. Pat. No. 4,836,427 to McManus (1989) disclosed a device to hold one to four tennis balls. However, the belt's construction of the ball retainer cages are not enclosed in a soft fabric bag for safety and suitably comfortable to wear in a game.

OBJECTS AND ADVANTAGES

Accordingly, several objects and advantages of our invention are:

a) To provide a safe flexible fabric pouch that is suitably comfortable and easy to use in a game of tennis.

b) Since tennis balls are sold in a quantity of three, our device can be used as a carrying case for the balls during non-sporting activity.

c) To provide a device that safely and adequately holds three balls as needed per game.

d) Our adjustable waist band can conveniently fit a wide range of users of all ages.

e) To provide a device that can be safely and quickly secured around the players waist with the easy to use snap-lock male/female buckle.

f) Our Criss-Cross design of the fabric pouch's elastic opening safely holds the balls in place, but at the same time allows easy access to the balls.

SUMMARY OF THE INVENTION

The principal object of the present invention is to provide an original device that is safe and simple to use while playing tennis that allows the player easy access to three tennis balls during the sporting activity. Further objectives and advantages will be accomplished by the following detailed descriptions.

DETAILED DESCRIPTION

Figure 1:
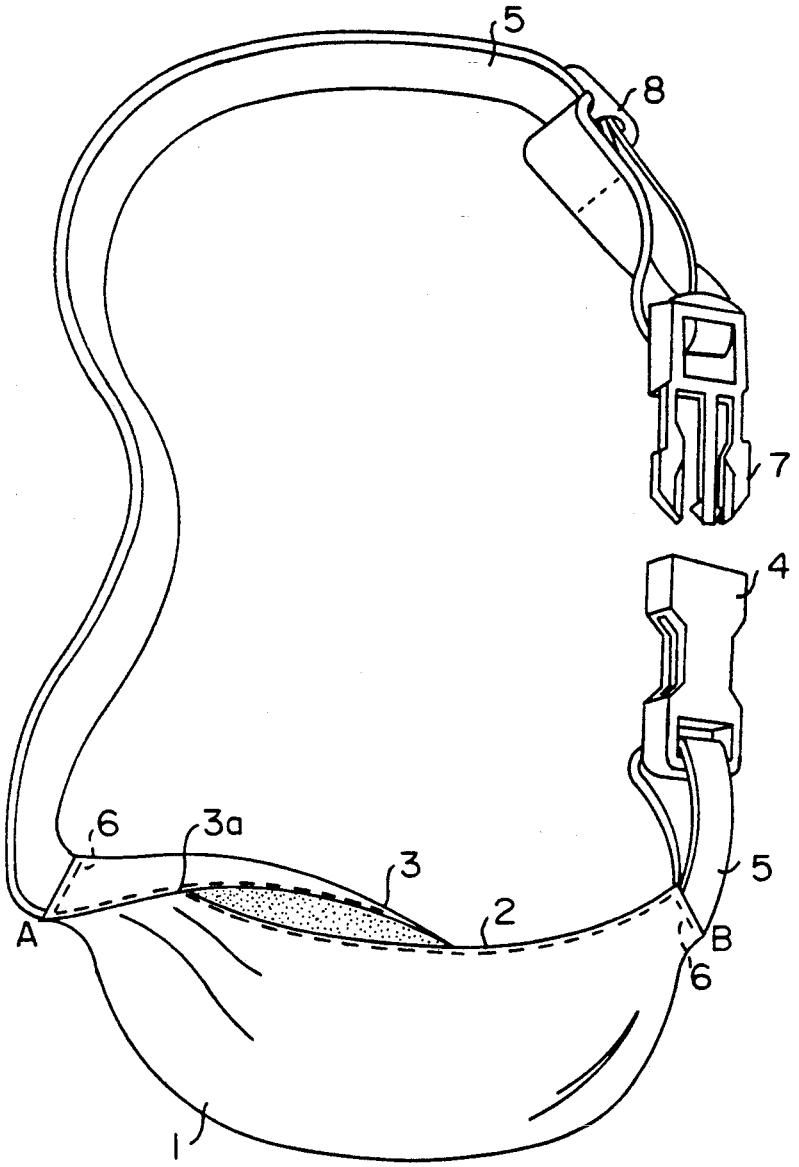
FIG. 1 is an overall drawing of a preferred embodiment of the invention.

Refer now to FIG. 1, which is an overall drawing of a Ball Belt sporting accessory designed to hold one to three tennis balls in accordance with the present invention. The Ball Belt device includes a semi-oval shaped pouch 1 with the opening 3 specifically designed and sewn with durable strength elastic 2 in a Criss-Crossed fashion 3A reverse stitched 6 to both sides of a nylon belt 5. The nylon belt 5 is attached to a male buckle 7, female buckle 4, and a three strand adjustor 8.

Figure 2A:
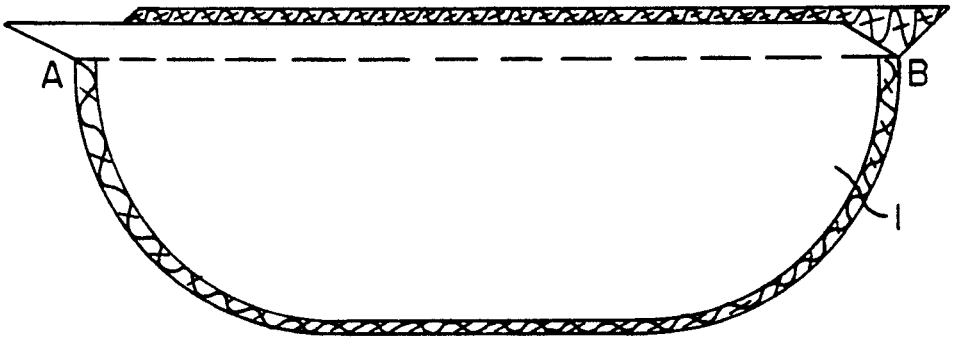
FIGS. 2*a–b* are views of the Ball Belt pouch of FIG. 1.

Refer now to FIG. 2*a*, which is a view of the Ball Belt pouch. It includes two pieces of 12 inches long by 5 inches wide flexible and stretchable semi-oval cut shaped fabric 1. The pouch is formed by stitching the right sides together from point a to point b with a one inch margin left open at the top. The elastic opening is formed by cutting 2 pieces of ¼ inch wide elastic, using the top straight opening edge of the fabric as a guide for the length. Elastic is pinned along each side of the pouch's opening edge and stitched together. The elastic is sewn to the top opening edge of each side of the fabric. It is then turned toward the wrong side of the fabric, folded to form an encasing for the elastic, and stitched through all thicknesses to secure.

Figure 3:
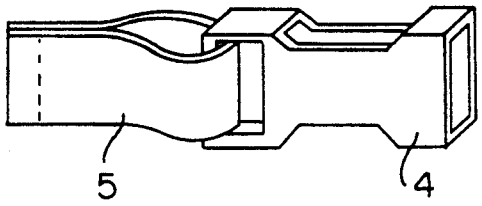
FIG. 3 is a fragmentary view of the left side of the present design.

Refer now to FIG. 3 which is a fragmentary view of the left side of the Ball Belt that has a total length of 3½ inches. It includes a plastic female buckle 4 U.S. Pat. No. 4,150,464) and a strand of nylon belt 5 which is 5 inches long by 1 inch wide. The nylon belt 5 is looped through the female buckle 4, folded and stitched to secure.

Figure 4:
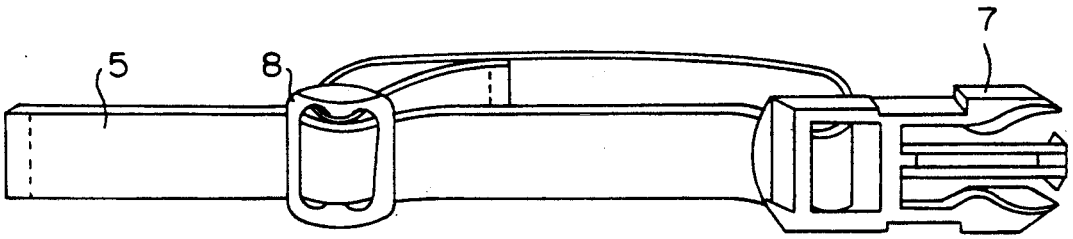
FIG. 4 is a fragmentary view of the right side of the present design.

Refer now to FIG. 4 which is the fragmentary view of the right side of the Ball Belt. It includes a strand of nylon belt 5 which is 27 inches long by 1 inch wide and a plastic male buckle 7 U.S. Pat. No. 4,171,555). One end of the nylon belt 5 is looped through a three strand adjustor 8, folded 1½ inches and sewn to secure. The other end of the nylon belt 5 is looped through the male buckle 7 and threaded back through the three strand adjustor 8.

Figure 2B:
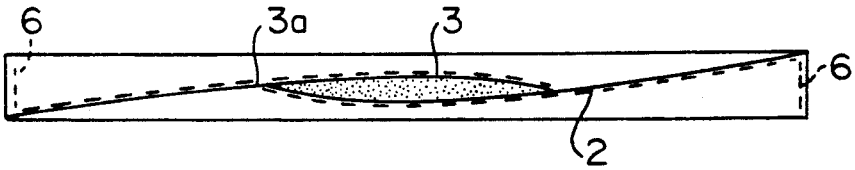

Refer to FIG. 2*b*, which illustrates the Criss-Crossed design of the pouch's opening. It is formed by placing the raw edge of the left side of the nylon belt (FIG. 3) between the correct side of the fabric against the raw edge of the left side of the pouch. The bottom edge of the pouch's opening is folded over the nylon belt. Then the top left edge of the pouch's opening is lapped over the bottom edge and sewn to secure.

To connect the right side of the nylon belt (FIG. 4) to the right side of the pouch, the same instructions as previously stated will apply, except the folding process has been reversed. The raw edge of the right side of the nylon belt (FIG. 4) is placed between the correct side of the fabric against the raw edge of the right side of the pouch. The top edge of the pouch's opening is folded over the nylon belt. Then the bottom right edge of the pouch's opening is lapped over the top edge and sewn to secure. The pouch's fabric is inverted so that the correct side of the fabric is facing outward. The edges of the attached belt are then reverse stitched to reinforce 6.

In use, the pouch can be stretched from 11½ inches to 16 inches in length and from 4 inches to 6 inches in width, so balls can easily be inserted and removed from the elastic opening. To accommodate different waist sizes, the nylon belt can be adjusted from a minimum of 22½ inches to a maximum length of 45¼ inches. The belt is constructed so the player can easily fasten the buckle at the side of the waist. After the buckle is snapped in place, the belt can be comfortably secured by sliding the three strand adjustor. The belt is also constructed so the player can position the pouch in the front or on the backside of the waist. The ball belt is also specifically designed to be used as a case to carry balls during non-sporting activity.

Although preferred embodiments of the invention have been described in the foregoing detailed description and illustrated in the accompanying drawings, it is not intended to be exhaustive or to limit the invention to the precise form disclosed.

Many modifications and variations are possible in light of the above illustration. It is intended that the scope of the invention be limited not by this detailed description, but rather by the claims appended hereto.

We claim:

1. A sporting accessory for holding a plurality of tennis balls around a waist of a user, said sporting accessory comprising:

a pouch formed from an elastic material wherein said pouch is adapted to receive said plurality of tennis balls;

and an adjustable belt assembly connected to opposite ends of said pouch and being adapted to surround the waist of a user, wherein said pouch includes a front panel and a rear panel, each of said panels having a top portion, a bottom, a first end and a second end, said front panel and said rear panel being connected to each other along said bottom and said ends, the top portions of said panels forming an elastic opening sized to permit entry and removal of tennis balls from said pouch, said opening being formed at a first end by folding and securing a portion of said top portion of said front panel and a portion of said first end of said front panel adjacent said top portion over a corresponding portion of said top portion of said rear panel and a portion of said first end of said back panel adjacent said top portion of said rear panel, said opening being formed at a second end by folding and securing a portion of said top portion of said rear panel and a portion of said second end of said rear panel adjacent said top portion over a corresponding portion of said top portion of said front panel and a portion of said second end of said back panel adjacent said top portion of said front panel, such that said top portion of said front panel is positioned above said top of said rear panel adjacent said first end and said top portion of said rear panel is positioned above said top portion of said front panel adjacent said second end and said top portions criss-cross at a point intermediate said first and second ends.

2. A sporting accessory according to claim 1, wherein said adjustable belt has a pair of ends wherein one end is connected to said pouch adjacent said first end of said opening and another end of said belt is connected to said pouch adjacent said second end of said opening.

3. A sporting accessory according to claim 2, wherein said adjustable belt is adjustable in length.

4. A sporting accessory according to claim 1, wherein said top portion of said rear panel and said front panel includes an elastic strip connected thereto.

5. A sporting accessory according to claim 1, wherein said pouch is sized to receive three tennis balls.

* * * * *